US010738541B2

(12) United States Patent
Myers et al.

(10) Patent No.: US 10,738,541 B2
(45) Date of Patent: Aug. 11, 2020

(54) SYSTEM AND METHOD FOR THREADED RISER AUXILIARY LINES

(71) Applicant: Hydril USA Distribution LLC, Houston, TX (US)

(72) Inventors: Gregory Jay Myers, Houston, TX (US); James Hunziker, Houston, TX (US); Farhat Shaikh, Houston, TX (US); Ranjit Jangili, Greenville, SC (US)

(73) Assignee: Hydril USA Distribution LLC, Houston, TX (US)

( * ) Notice: Subject to any disclaimer, the term of this patent is extended or adjusted under 35 U.S.C. 154(b) by 0 days.

(21) Appl. No.: 16/266,518

(22) Filed: Feb. 4, 2019

(65) Prior Publication Data

US 2019/0242198 A1 Aug. 8, 2019

Related U.S. Application Data

(60) Provisional application No. 62/625,758, filed on Feb. 2, 2018.

(51) Int. Cl.
*E21B 17/01* (2006.01)
*E21B 17/042* (2006.01)
*E21B 17/08* (2006.01)

(52) U.S. Cl.
CPC ..... *E21B 17/0423* (2013.01); *E21B 17/01* (2013.01); *E21B 17/042* (2013.01); *E21B 17/085* (2013.01)

(58) Field of Classification Search
CPC .... E21B 17/01; E21B 17/042; E21B 17/0423; E21B 17/085
See application file for complete search history.

(56) References Cited

U.S. PATENT DOCUMENTS 3,345,084 A * 10/1967 Hanes ..... E21B 17/046 285/27
4,043,575 A 8/1977 Roth
(Continued)

FOREIGN PATENT DOCUMENTS

| | | |
|---|---|---|
| WO | 2010/026373 | 3/2010 |
| WO | 2011/104629 | 9/2011 |
| WO | 2015/038000 | 3/2015 |

OTHER PUBLICATIONS

GE Oil & Gas, "Drilling Systems reliable to the extremes," 2009, 15 pages.

(Continued)

*Primary Examiner* — Matthew R Buck
(74) *Attorney, Agent, or Firm* — Hogan Lovells US LLP

(57) ABSTRACT

A system for coupling a first pipe segment to a second pipe segment includes a pin coupled to the first pipe segment, the pin having a first outer diameter and a second outer diameter, the second outer diameter forming a recess along at least a portion of the pin. The system also includes a box coupled to the second pipe segment, the box having an opening, the opening receiving at least a portion of the pin, wherein at least a portion of a wall of the opening includes threads. The system further includes a rotating threaded collar arranged within the recess, at least a portion of the rotating threaded collar including mating threads configured to engage the threads of the box, wherein the rotating threaded collar is rotatable about the pin.

19 Claims, 10 Drawing Sheets

(56) References Cited

U.S. PATENT DOCUMENTS

| | | | | |
|---|---|---|---|---|
| 4,374,595 | A * | 2/1983 | Watkins | E21B 17/085 285/123.14 |
| 4,496,173 | A * | 1/1985 | Roche | F16L 39/00 285/24 |
| 4,652,021 | A * | 3/1987 | Pido | E21B 17/046 285/81 |
| 4,708,513 | A * | 11/1987 | Roche | E21B 17/085 403/361 |
| 4,830,408 | A * | 5/1989 | Reimert | E21B 17/046 285/27 |
| 6,106,024 | A * | 8/2000 | Herman | E21B 17/085 285/18 |
| 6,857,668 | B2 | 2/2005 | Otten et al. | |
| 7,231,983 | B2 * | 6/2007 | Lequang | E21B 33/038 166/368 |
| 7,344,162 | B2 | 3/2008 | Van Bilderbeek | |
| 8,561,706 | B2 | 10/2013 | Averbuch et al. | |
| 8,672,366 | B2 | 3/2014 | Mogedal et al. | |
| 8,733,452 | B2 | 5/2014 | Guesnon et al. | |
| 8,869,900 | B2 | 10/2014 | Sawtell et al. | |
| 9,022,125 | B2 * | 5/2015 | Weir | E21B 17/085 166/350 |
| 10,012,031 | B2 | 7/2018 | Fraczek et al. | |
| 10,012,044 | B2 * | 7/2018 | Leba | E21B 21/08 |
| 10,087,687 | B2 * | 10/2018 | Gilmore | E21B 17/07 |
| 2011/0225789 | A1 * | 9/2011 | Darnell | E21B 33/072 29/428 |
| 2011/0227336 | A1 | 9/2011 | Mogedal | |
| 2012/0037377 | A1 | 2/2012 | Walker | |
| 2014/0232109 | A2 | 8/2014 | Nguyen | |
| 2017/0152978 | A1 | 6/2017 | Leeth et al. | |
| 2017/0298699 | A1 | 10/2017 | Riggs et al. | |
| 2018/0252055 | A1 | 9/2018 | Persent et al. | |

OTHER PUBLICATIONS

Dril-Quip, "Rapid-dePLOY Marine Drilling System," 2014, 16 pages.

Baker Hughes, "MR eXplorer Magnetic resonance logging service," 2011, 12 pages.

MHWirth, "Drilling Riser," 2017, 2 pages.

* cited by examiner

SYSTEM AND METHOD FOR THREADED RISER AUXILIARY LINES

CROSS REFERENCE TO RELATED APPLICATIONS

This application claims priority to U.S. Provisional Patent Application No. 62/625,758, titled "SYSTEM AND METHOD FOR THREADED RISER AUXILIARY LINES," filed on Feb. 2, 2018, the disclosure of which is incorporated herein by reference in its entirety.

BACKGROUND OF THE DISCLOSURE

1. Field of the Disclosure

This disclosure relates in general to oil and gas service methodologies utilizing tools, and in particular, to systems and methods for providing threaded riser auxiliary lines.

2. Brief Description of Related Art

In oil and gas production, drilling and recovery may be conducted at sea, which may include platforms or rigs having risers to adjust a position of the platform in response to movement of the ocean. The risers may provide an upward force on the platform to enable the platform to raise and lower along with the sea, thereby reducing the likelihood of causing excess strain and movement to components of the drilling system. In various embodiments, the riser tensioners may include hydraulic cylinders that receive a high pressure fluid to apply the force to the platform. Furthermore, the risers may include auxiliary lines to transport various fluids to different portions of the drilling operation. For example, hydraulic fluid may be transmitted to subsea components, such as a blowout preventer (BOP). In operation, the auxiliary lines may include box and pin connectors to couple the pressure containing portions of the line together. In the event the line fails, the riser is generally taken offline and sent to shore for repairs. This causes undesirable delays and is costly to producers.

SUMMARY OF THE DISCLOSURE

Applicants recognized the problems noted above herein and conceived and developed embodiments of systems and methods, according to the present disclosure, for coupling auxiliary lines.

In an embodiment a system for coupling a first pipe segment to a second pipe segment includes a pin coupled to the first pipe segment, the pin having a first outer diameter and a second outer diameter, the first outer diameter being larger than the second outer diameter, the second outer diameter forming a recess along at least a portion of the pin. The system also includes a box coupled to the second pipe segment, the box having an opening with an inner diameter larger than the first outer diameter, the opening receiving at least a portion of the pin, wherein at least a portion of a wall of the opening includes threads. The system further includes a rotating threaded collar arranged within the recess, at least a portion of the rotating threaded collar including mating threads configured to engage the threads of the box, wherein the rotating threaded collar is rotatable about the pin.

In another embodiment a system for installing auxiliary tubing includes a riser joint including a flange, the flange extending radially outward from a main line and having a plurality of apertures. The system also includes an auxiliary line coupled to the flange via a lock nut, the auxiliary line extending through an aperture of the plurality of apertures, wherein the auxiliary line comprises a first segment and a second segment coupled together via an auxiliary joint assembly. The auxiliary joint assembly includes a pin coupled to the first segment, the pin having a variable outer diameter including a recess. The auxiliary joint assembly also includes a box coupled to the second segment, the box having an opening including a variable inner diameter, wherein at least a portion of the variable outer diameter of the pin corresponds to a mating portion of at least a portion the variable inner diameter of the box. The auxiliary joint assembly further includes a rotating threaded joint coupled to the pin and arranged within the recess, wherein the rotating threaded joint is axially and radially restricted along the joint and is rotatable about the pin to couple the pin to the box.

In an embodiment a method for coupling a first pipe segment to a second pipe segment includes coupling a pin to the first pipe segment, the pin including a recess. The method also includes installing a rotating threaded collar within the recess. The method further includes coupling a box to the second pipe segment. The method also includes aligning the pin with the box such that at least a portion of the pin extends into an opening in the box and threads of the box contact mating threads of the rotating threaded collar. The method further includes rotating the rotating threaded collar to engage the threads of the box.

BRIEF DESCRIPTION OF THE DRAWINGS

The present technology will be better understood on reading the following detailed description of non-limiting embodiments thereof, and on examining the accompanying drawings, in which.

DETAILED DESCRIPTION OF THE PREFERRED EMBODIMENT

Figure 1:
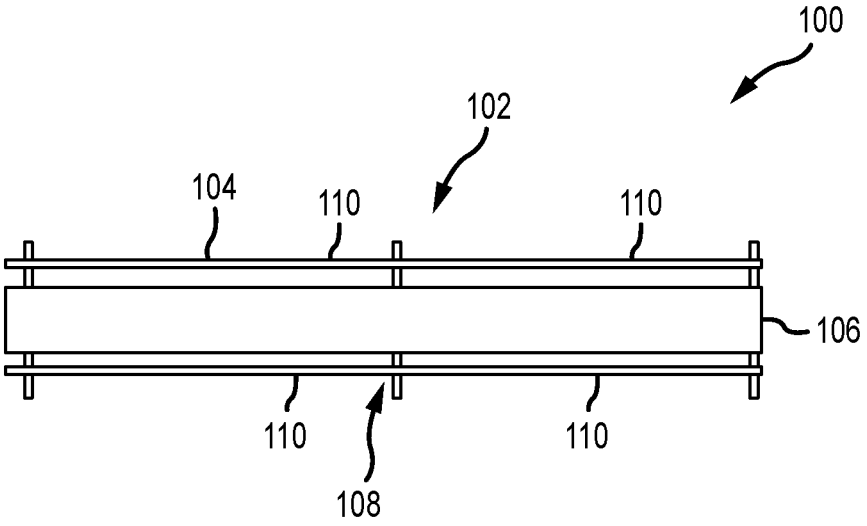
FIG. 1 is a schematic side view of an embodiment of a riser joint, in accordance with embodiments of the present disclosure.

The foregoing aspects, features and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. The present technology, however, is not intended to be limited to the specific terms used, and it is to be understood that each specific term includes equivalents that operate in a similar manner to accomplish a similar purpose.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments," or "other embodiments" of the present invention are not intended to be interpreted as excluding the existence of additional embodiments that also incorporate the recited features. Furthermore, reference to terms such as "above," "below," "upper", "lower", "side", "front," "back," or other terms regarding orientation are made with reference to the illustrated embodiments and are not intended to be limiting or exclude other orientations.

Embodiments of the present disclosure include systems and methods for repairing and/or replacing auxiliary lines associated with offshore drilling equipment, such as risers, to reduce the downtime or cost associated with repairs or replacements. In certain embodiments, a rotating threaded collar (RTC) is coupled to a box end of an auxiliary line, which receives a pin end to couple segments of the line together. The rotating threaded collar enables quick, efficient coupling and decoupling of components of the auxiliary line. Accordingly, repairs can be made without welding and without sending the riser back to shore for repairs. That is, the riser may be repaired on the platform, reducing the time and cost associated with making repairs.

In various embodiments, systems and methods of the present disclosure are directed toward an auxiliary joint assembly that facilities non-welded connections between auxiliary line segments. In certain embodiments, threaded fittings are utilized to provide a coupling between a first segment and a second segment. For example, a pin may be coupled to an end of a pipe segment and coupled to a box via engagement of threads and mating threads. In various embodiments, the pin includes a rotating threaded collar that enables installation of the pin without rotation of the pin. Rather, the rotating threaded collar may rotate about the pin to pull or engage mating threads of the box. As a result, replacement segments may be installed without welding at the site because the replacement segments may be coupled together via the threads.

In certain embodiments, the box and pin assembly may include seals, for example a dual seal, to reduce the likelihood of leaks at the connections made via the threaded components. In various embodiments, dimensions of the box and pin connector may be particularly selected based at least in part on anticipated operating conditions. As a result, loading along the auxiliary line may be accommodated via the box and pin assembly without adding additional supports to the auxiliary line.

FIG. 1 is a schematic side view of an embodiment of a segment 100 of a riser joint 102 that includes auxiliary lines 104 arranged radially outward from a main line 106 of the riser joint 102 and that are substantially parallel to the main line 106. The riser joint 102 may also be referred to as a Marine Drilling Riser that may be approximately 75 feet long, but may also be as long as approximately 90 feet or even longer. The auxiliary lines 104 may be clamped along the sides of the main line 106 for transmitting drilling fluids and hydraulic fluids as needed for various components, such as blowout preventer (BOP) control. In various embodiments, there may be approximately five auxiliary lines 104 coupled to the main line 106. For example, individual lines may be for choke, for kill, for boost, and two may provide hydraulic control. In various embodiments, the auxiliary lines 104 include a pin end and a box end 108 to facilitate coupling between different sections 110 of the auxiliary lines 104. For example, the auxiliary lines 104 may be long and the lines may be broken into the sections 110 in order to enable repairs to certain sections 110 without working on the entire length of the auxiliary line 104. As used herein, line may refer to a tubular or pipe-like connection to facilitate transmission of a liquid, gas, solid, or a combination thereof (which may be referred to herein as a "fluid") under pressure.

In operation, the pin end is inserted into a corresponding box end to form a pressure-containing connection between different sections 110 of the auxiliary line 104. In various embodiments, the sections 110 may be welded together, for example at an interface between the pin and box ends. This welded connection may enable high-pressure transmission of fluids through the auxiliary lines. In various embodiments, the pressures within the lines may be approximately 30,000 pounds per square inch (psi). Accordingly, robust connections are utilized in order to reduce the likelihood of leaks.

Sections 110 of the auxiliary line 104 may become damaged or otherwise unusable during operations, such as due to contact from outside forces, normal wear and tear, and the like. When the auxiliary lines 104 are damaged, the riser 102 is taken out of service and sent to shore for repairs because the sections 110 may be welded together. This process presents logistical challenges and costly operational delays. Systems and methods of the present disclosure provide a non-welded connection between sections 110 of the auxiliary lines 104, thereby enabling repairs on the platform. That is, repairs without sending the riser 102 back to shore. As such, the logistical challenges may be substantially eliminated and the time and cost associated with the repairs or replacement may be reduced.

Figure 2:
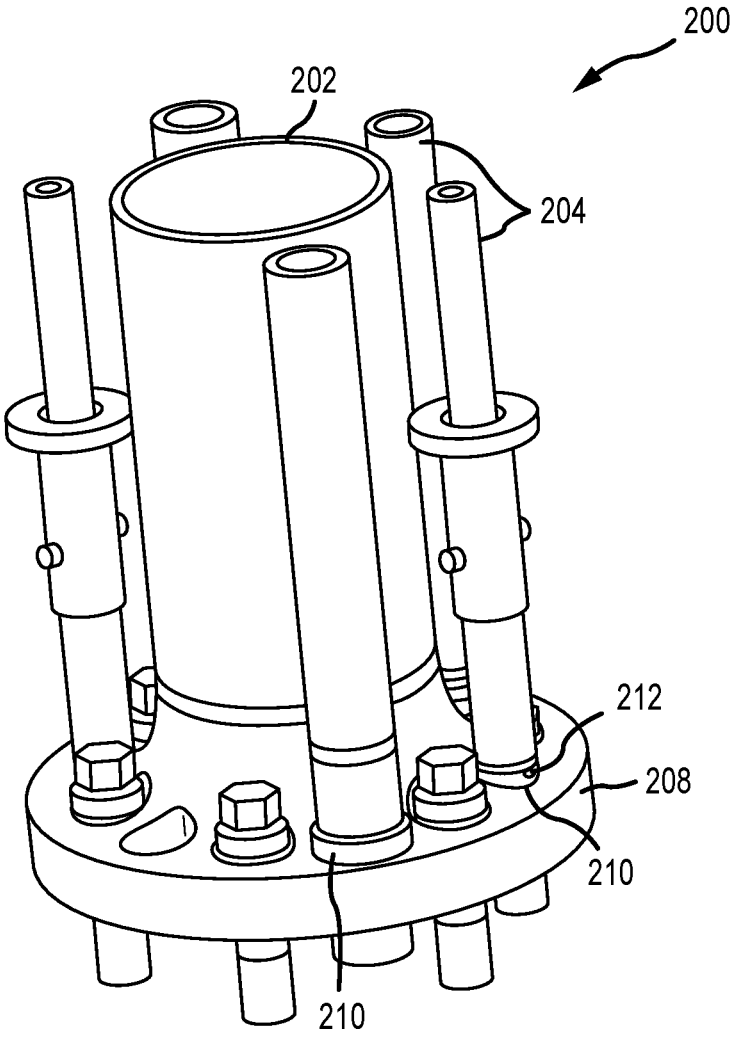
FIG. 2 is a perspective view of an embodiment of a riser joint, in accordance with embodiments of the present disclosure.

FIG. 2 is an isometric view of an embodiment of a riser segment 200 that includes a main line 202 and a plurality of auxiliary line 204. It should be appreciated that the five auxiliary lines 204 are for illustrative purposes only and that, in various embodiments, more or fewer auxiliary lines 204 may be included. The auxiliary lines 204 are arranged radially outward from the main line 202 with respect to an axis 206 and positioned circumferentially about a circumference of the main line 202. A flange 208 is coupled to the main line 202 and includes apertures 210 for receiving the auxiliary line 204. In various embodiments, the flange 208 may include additional couplings and/or fixtures 212 to facilitate securing the auxiliary line 204 to the flange 208. It should be appreciated that the auxiliary line 204 may have different diameters and include additional components, such as thrust columns, which will be described herein.

Figure 3:
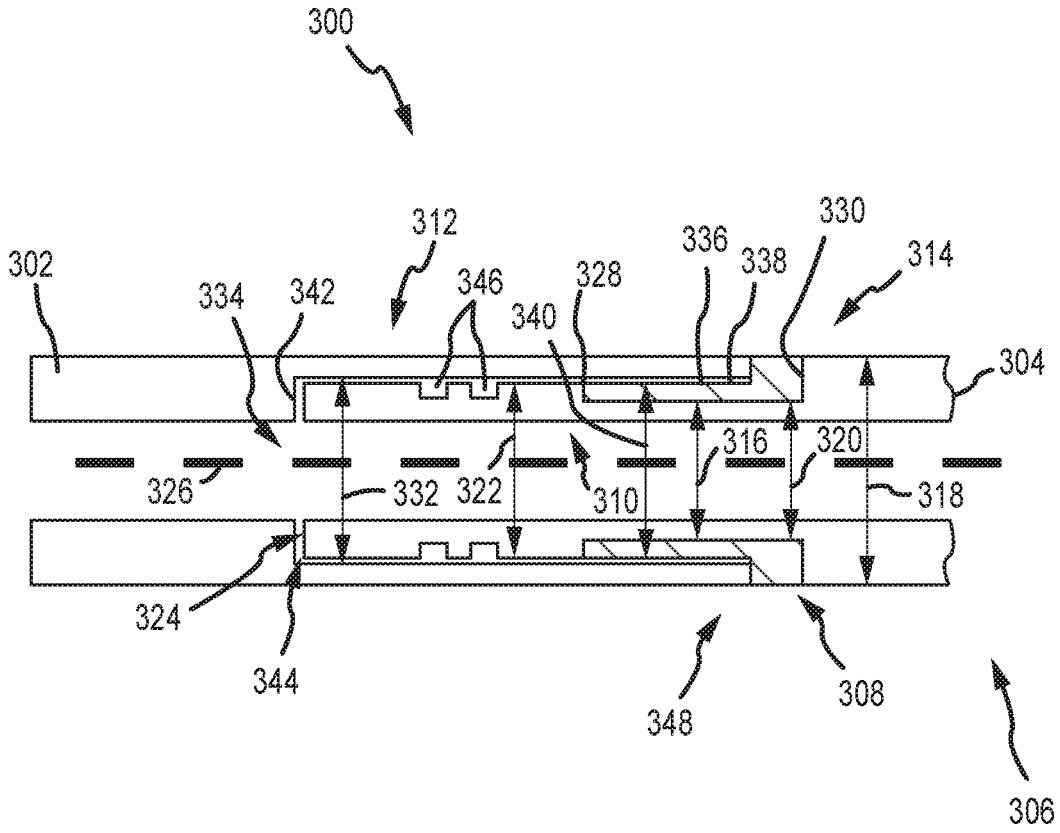
FIG. 3 is a schematic cross-sectional view of an embodiment of an auxiliary joint assembly, in accordance with embodiments of the present disclosure.

FIG. 3 is a schematic cross-sectional side view of an embodiment of an auxiliary joint assembly 300 to facilitate coupling of adjacent first segment 302 and second segment 304 of auxiliary line 306. The illustrated auxiliary joint assembly 300 includes a rotating threaded collar (RTC) 308 arranged between a pin 310 and box 312 of the auxiliary line segments 302, 304 to facilitate coupling of the segments 302, 304. In various embodiments, the RTC 308 enables the pin 310 to be coupled to the box 312 without welding (e.g., via threads) which may provide an easier joint for replacement. In various embodiments, the RTC 308 is formed from a corrosion resistant alloy, such as an alloy consisting of metals that may include chrome, stainless steel, cobalt, nickel, iron, titanium, molybdenum, and the like which may further provide longevity of the RTC 308 and/or the joint assembly 300.

In various embodiments, the RTC 308 is arranged within a recess 314 formed in the auxiliary line at the pin 310. The recess has a first diameter 316 that is less than a segment diameter 318. In certain embodiments, the RTC 308 is a split collar design, which may be coupled together via fasteners or the like. As illustrated in FIG. 3, the RTC 308 has an inner diameter 320 that is greater than the first diameter 316 but less than a third diameter 322 of an end 324 of the pin 310. Accordingly, while axial movement of the RTC 308 along an axis 326 may be restricted, installing the RTC 308 on the pin 310 may include the fasteners so that the RTC 308 may be formed as a split collar. In various embodiments, the RTC 308 rotates about the axis 326, which as described below, may bring the first segment 302 toward the second segment 304 to facilitate coupling of the auxiliary line 306. The RTC 308 may include a lubricant positioned between the RTC inner diameter 320 and the pin 310 at the first diameter 316 to facilitate rotation and reduce friction as the RTC 308 rotates about the axis 326.

As described above, axial movement of the RTC 308 may be restricted within the recess 314. For example, the RTC 308 may be arranged between a first shoulder 328 and a second shoulder 330, which block axial movement along the axis 326. In various embodiments, the mating components of the RTC 308 proximate the shoulders 328, 330 are approximately an equal thickness, although in other embodiments the thicknesses of the respective components may vary based on design considerations, such as expected operating conditions. As will be described below, in various embodiments the RTC 308 is configured to have an approximately equal outer diameter as the first and second segment 302, 304, thereby forming a substantially equal or continuous outer profile of the auxiliary line 306. However, in various other embodiments, there may be a changing outer diameter (e.g., larger or small) at the RTC 308, which may provide a quick visual indication to an operation as to the location of the RTC 308.

In various embodiments, the box 312 includes a fourth diameter 332 that is larger than the third diameter 322 such that the end 324 may pass into an opening 334 formed by the box 312. In the illustrated embodiment, at least a portion of the fourth diameter 322 includes threads 336 to facilitate coupling to the RTC 308, which may include mating threads 338 along at least a portion of a fifth diameter 340, which may be substantially equal to the third diameter 322. In operation, engagement of the threads 336 and mating threads 338 may enable coupling of the first segment 302 to the second segment 304 via rotation of the RTC 308 to axially move the first segment 302 toward the second segment 304.

In the illustrated embodiment, the end 324 abuts a box shoulder 342 arranged within opening 334, which may block further axial movement of the box 312 relative to the pin 310. In certain embodiments, a gap 344 is arranged between the box shoulder 342 and the end 324 to enable expansion, contraction, movement, and the like while minimizing stress or impingement points between the pin 310 and the box 312. Furthermore, in embodiments, there may be gaskets or the like arranged between potential impingement points (e.g., the gap 344, between the first shoulder 328 and the RTC, between an end of the box 312 and the RTC, etc.) to reduce the likelihood of contact between the components. However, in various embodiments, metal-to-metal sealing between various components may be desirable, and as a result, the gaskets or the like may not be used.

In certain embodiments, the end 324 includes a pair of grooves 346 that may receive o-rings, gaskets, seals, or the like (not illustrated). In various embodiments, the pair of grooves 346 may enable a double seal between the pin 310 and the box 312, however, it should be appreciated that more or fewer grooves 346 may be utilized.

As described above, in first segment 302 is coupled to the second segment 304 via engagement of the threads 336 and mating threads 338. For example, the box 312 may be arranged at least partially overlap the RTC 308, for example, by inserting the end 324 at least partially into the opening 334. Thereafter, the RTC 308, for example, via an exposed portion 348 that facilitates operation of the RTC 308, may be utilized to form a connection between the pin 310 and the box 312. Rotation of the RTC couples or pulls the box 312 to the pin 310 without the use of a welded connection, thereby enabling faster repairs or replacements on the platform, rather than sending the riser to shore for welding new segments of auxiliary line 306. Furthermore, damaged or worn components may be decoupled from the auxiliary line 306 via rotation of the RTC 308 in an opposite direction to push the box 312 off of the pin 310. In this manner, portions of the auxiliary line 306 may be replaced or repaired with reduced cost and downtimes. In various embodiments, this may be done for the box end of the line as well. That is, a groove may be formed in the box 312 to receive the RCE 308 in other embodiments.

Figure 4:
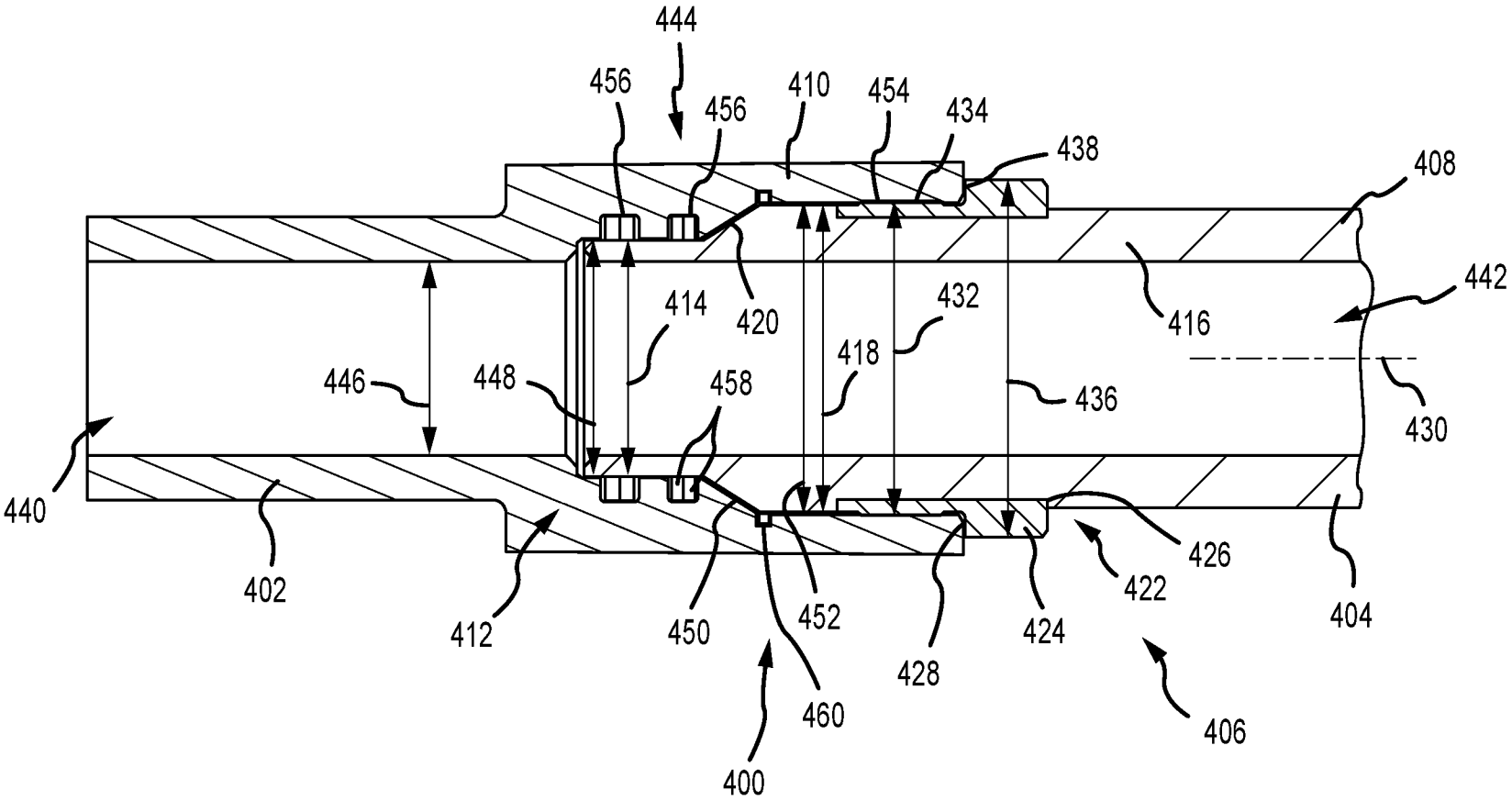
FIG. 4 is a schematic cross-sectional view of an embodiment of an auxiliary joint assembly, in accordance with embodiments of the present disclosure.

FIG. 4 is a cross-sectional view of an embodiment of an auxiliary joint assembly 400 which may be utilized to couple a first segment 402 and a second segment 404 of an auxiliary line 406 together. In the illustrated embodiment, the first segment 402 includes a pin 408 and the second segment 404 includes a box 410. As illustrated, when joined together at least a portion of the pin 408 overlaps at least a portion of the box 410.

Referring to the pin 408, the illustrated embodiment includes an end 412 having a first diameter 414 and a body 416 having a second diameter 418 with a transition 420 between. As illustrated, the first diameter 414 is less than the second diameter 418, with the transition 420 including a sloped surface to facilitate the transition between the first diameter 414 to the second diameter 418. In various embodiments, the transition 420 may facilitate a metal-to-metal seal between the box 410 and the pin 408.

The illustrated pin 408 further includes a recess 422 formed in the body 416 to receive a RTC 424. As described above, in various embodiments the RTC 424 may be arranged between a first shoulder 426 and a second shoulder 428 to restrict axial movement of the RTC 424 along an axis 430. In operation, the RTC 424 may rotate about the axis 430. For example, a lubricant, such as grease or a dry lubricant, may be arranged between the RTC 424 and the body 416 within the recess 422. Furthermore, in embodiments, the surface finish of at least one of the RTC 424 or the body 416 may facilitate rotational of the RTC 424 about the axis 430. In certain embodiments, as described above, the RTC 424 may be a split ring that is coupled together via one or more fasteners to facilitate installation of the RTC 424 on the box 410.

In various embodiments, at least a portion of an outer diameter 432 of the RTC 424 includes threads 434. The threads 434 may be arranged such that engagement of the box 410 occurs prior to the setting of seals arranged within the pin 408, which will be described below. Furthermore, the illustrated RTC 424 includes a second outer diameter 436 that may be larger than the outer diameter 432. The second outer diameter 436 may facilitate formation of an RTC shoulder 438, which may be used to block axial movement of the box 410 along the axis 430 past a predetermined point. In various embodiments, the second outer diameter 436 is larger than the second diameter 418 such that a flush or even outer profile is not formed in favor of a stepped profile, such as the profile illustrated in FIG. 4. However, it should be appreciated that the diameters may be equal, such as the embodiment illustrated in FIG. 3.

Turning to the box 410, a bore 440 is arranged to extend to a mating bore 442 of the pin 408, which facilitates flow of a fluid through the auxiliary line 406. The box 410 includes a variable inner diameter 444 that includes a first inner diameter 446 representative of the bore 442, a second inner diameter 448 that aligns with the end 412, a box transition 450, and a third inner diameter 452 that aligns with at least a portion of the body 416 and the RTC 424. In various embodiments, at least a portion of the third inner diameter 452 includes threads 454 that mate with the threads 434 of the RTC 424. Accordingly, the pin 408 may be coupled to the box 410 via a threaded connection without rotating the pin 408. In various embodiments, the box 410 may be configured to not rotate during coupling to the pin 408.

In various embodiments, the box 410 includes grooves 456 that may receive o-rings, gaskets, seals 458, or the like. The illustrated box 410 includes a pair of grooves 456, thereby including a double seal at the connection between the pin 408 and the box 410. Furthermore, in various embodiments, a thread relief 460 is arranged along the third inner diameter 452. The illustrated thread relief 460 enables pressure relief, for example from axial pressures along the axis 430. It should be appreciated that dimensions of the thread relief 460 may be particularly selected based on expected operating conditions or in response to other dimensions of the pin 408 and/or the box 410, which may vary based on design conditions.

As described above, in operation the pin 408 may be aligned with the box 410 and at least a portion of the end 412 may be overlapped by the box 410. Engagement of the threads 434, 454 may be facilitated before engagement of the seals 458, thereby providing loading of the seals 458 as the box 410 is driven toward the pin 408 via rotation of the RTC 424 about the axis 430. Accordingly, the connection between the first segment 402 and the second segment 404 may be formed using the RTC 424, thereby eliminating or removing a welding operation for coupling the first segment 402 to the second segment 404.

Figure 5:
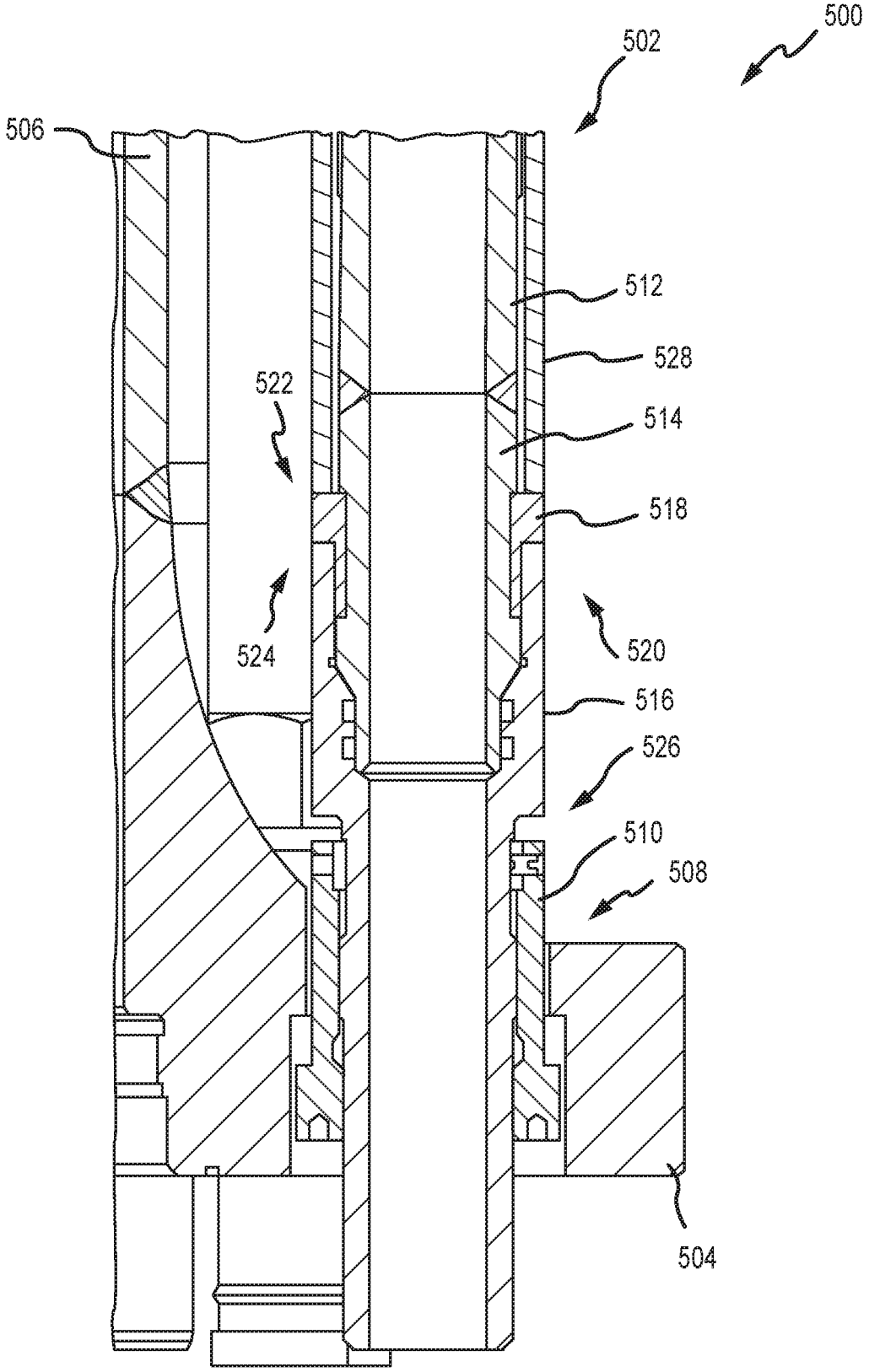
FIG. 5 is a schematic cross-sectional view of an embodiment of an auxiliary joint assembly, in accordance with embodiments of the present disclosure.

FIG. 5 is a cross-sectional view of an embodiment of a riser segment 500 including an auxiliary line 502 coupled to a flange 504 extending from a main line 506. In the illustrated embodiment, the auxiliary line 502 extends through an aperture 508 of the flange 504 and includes a lock nut 510 that secures the auxiliary line 502 to the flange 504. In the illustrated embodiment, a pipe segment 512 is coupled to a pin 514. For example, the pin 514 may be welded to an end of the pipe segment 512, as shown in the illustrated embodiment. It should be appreciated that such a connection may be formed prior to installation of the auxiliary line 502, for example, at the shore, thereby reducing the likelihood of a welding operation on the offshore platform.

The illustrated pin 512 is coupled to a box 516 via a RTC 518, as described above with respect to FIGS. 3 and 4. The RTC 518 is pictured arranged within a recess 520 formed in the pin 512 such that an outer profile 522 of the auxiliary line 502 is substantially constant at the connection formed by the auxiliary joint assembly 524. However, as noted above, in various embodiments the outer profile 522 may be stepped our uneven. For example, the RTC 518 may be recessed or extend radially outward to provide a visual indication to the operator regarding the location of the RTC 518.

In operation, the box 516 may be fixed to the flange 506 via the lock nut 510, and as a result, the pin 512 and associated piping may be preferably replaced during operations. However, in various embodiments, a gap 526 or the like may be arranged to enable axial movement of the box 516 along an axis 528 to facilitate removal of the pin 512. Additionally, in various embodiments, the box 516 may also be removed, for example, via removal of the lock nut 510 which would enable the box 516 to pass through the aperture 508.

In the illustrated embodiment, a thrust column 528 is arranged circumferentially and co-axially with the pin 514. In various embodiments, the thrust column 528 may bear against the RTC 518, which bears against and/or transmits forces to the box 516. It should be appreciated that the thrust column 528 may be utilized to transmit forces along the auxiliary line 502 and to facilitate strengthening of the auxiliary line 502.

Figure 6:
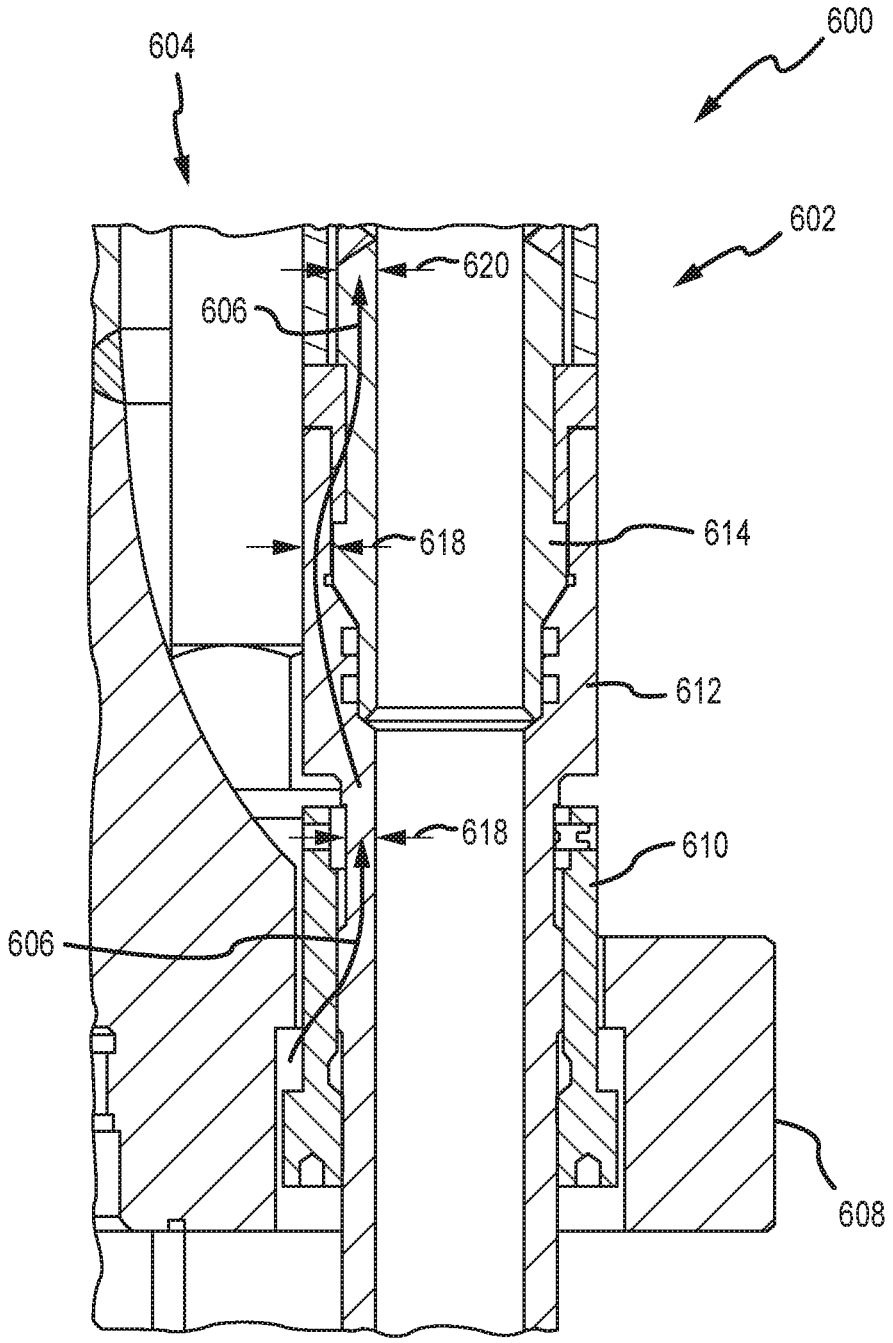
FIG. 6 is a schematic cross-sectional view of an embodiment of an auxiliary joint assembly illustrating a load path, in accordance with embodiments of the present disclosure.

FIG. 6 is a cross-sectional view of an embodiment of a loading scenario 600 on an auxiliary line 602 coupled to riser segment 604. A load path 606 is generated due to a force applied to the auxiliary line 602 and/or the riser segment 604, for example via an external force or a force from a component coupled to the line 602 and/or the riser segment 604. The load path 606 extends through the flange 608 and is transmitted to the auxiliary line 602 via a lock nut 610. Thereafter, loading is transmitted through a box 612 and to a pin 614. It should be appreciated that various components are particularly configured to accommodate the illustrated load path 606. For example, a first thickness 616 and second thickness 618 of the box 612 may be particularly selected to accommodate the load path 606. Furthermore, a third thickness 620 of the pin 614 may also be particularly selected to accommodate the load path 606. Accordingly, it should be appreciated that various components of the illustrated embodiment may be adjusted and/or changed based on anticipated operating conditions.

Figure 7A:
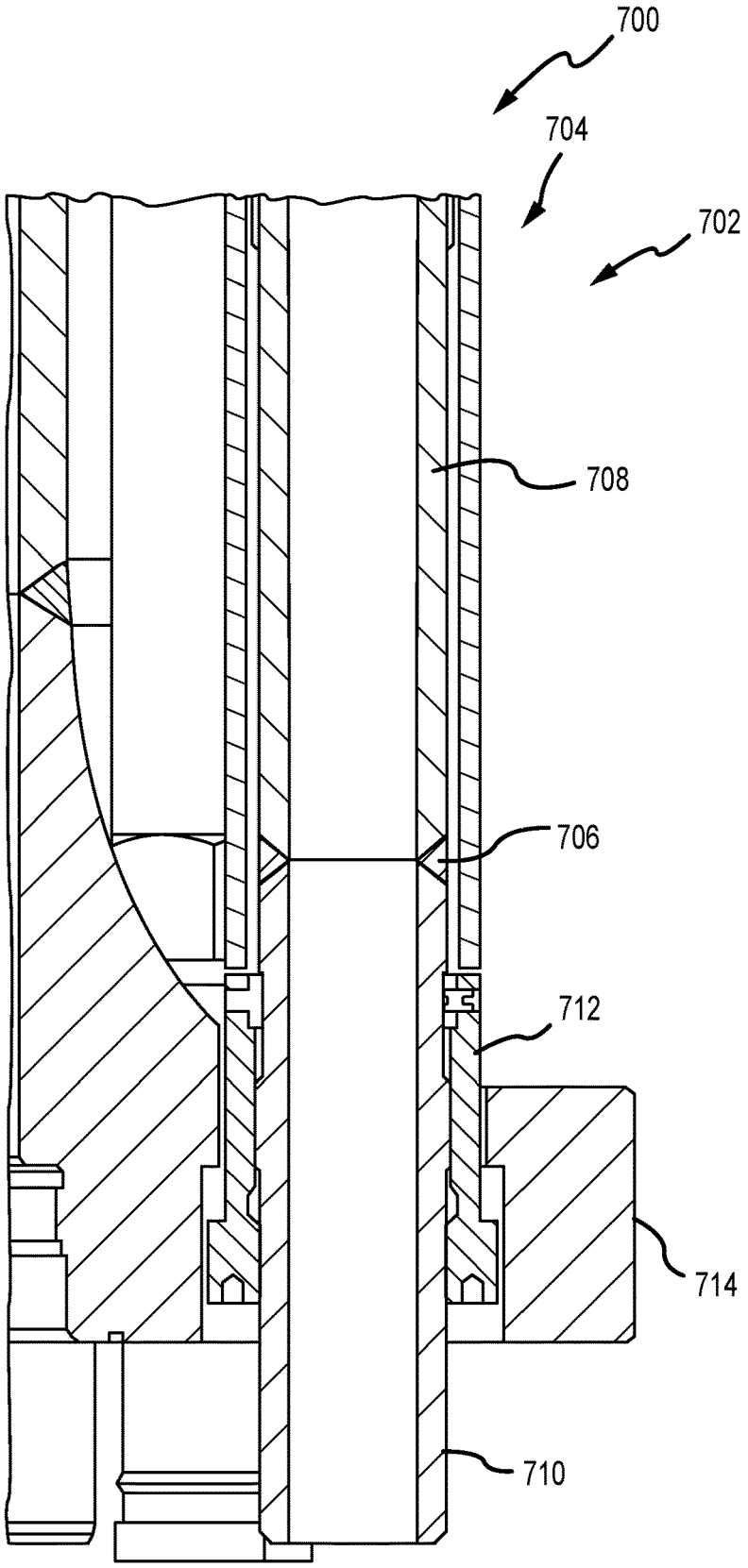
FIG. 7A is a schematic cross-sectional view of an embodiment of an auxiliary line configuration, in accordance with embodiments of the present disclosure.
Figure 7B:
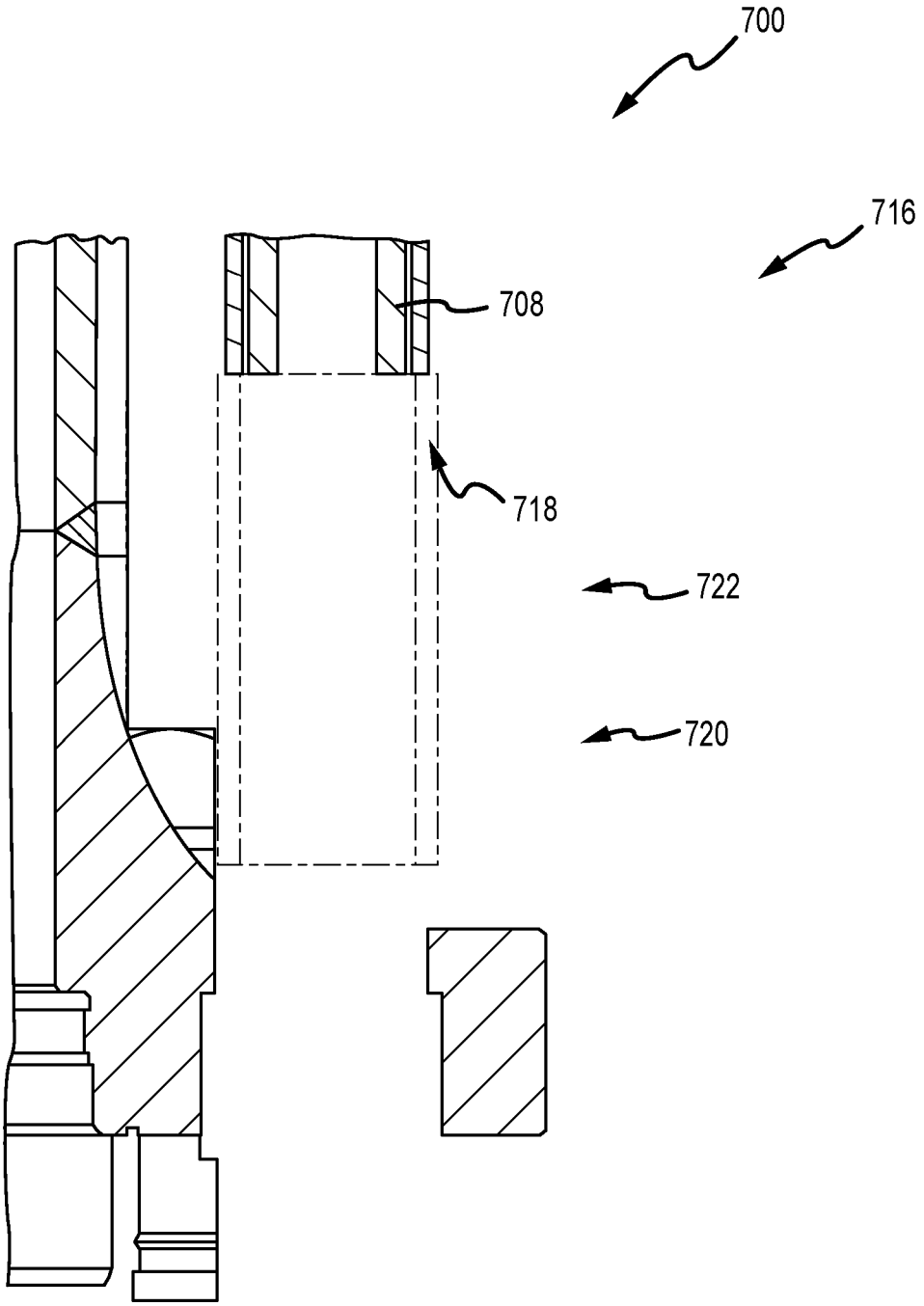
FIG. 7B is a schematic cross-sectional view of an embodiment of an intermediate configuration, in accordance with embodiments of the present disclosure.
Figure 7C:
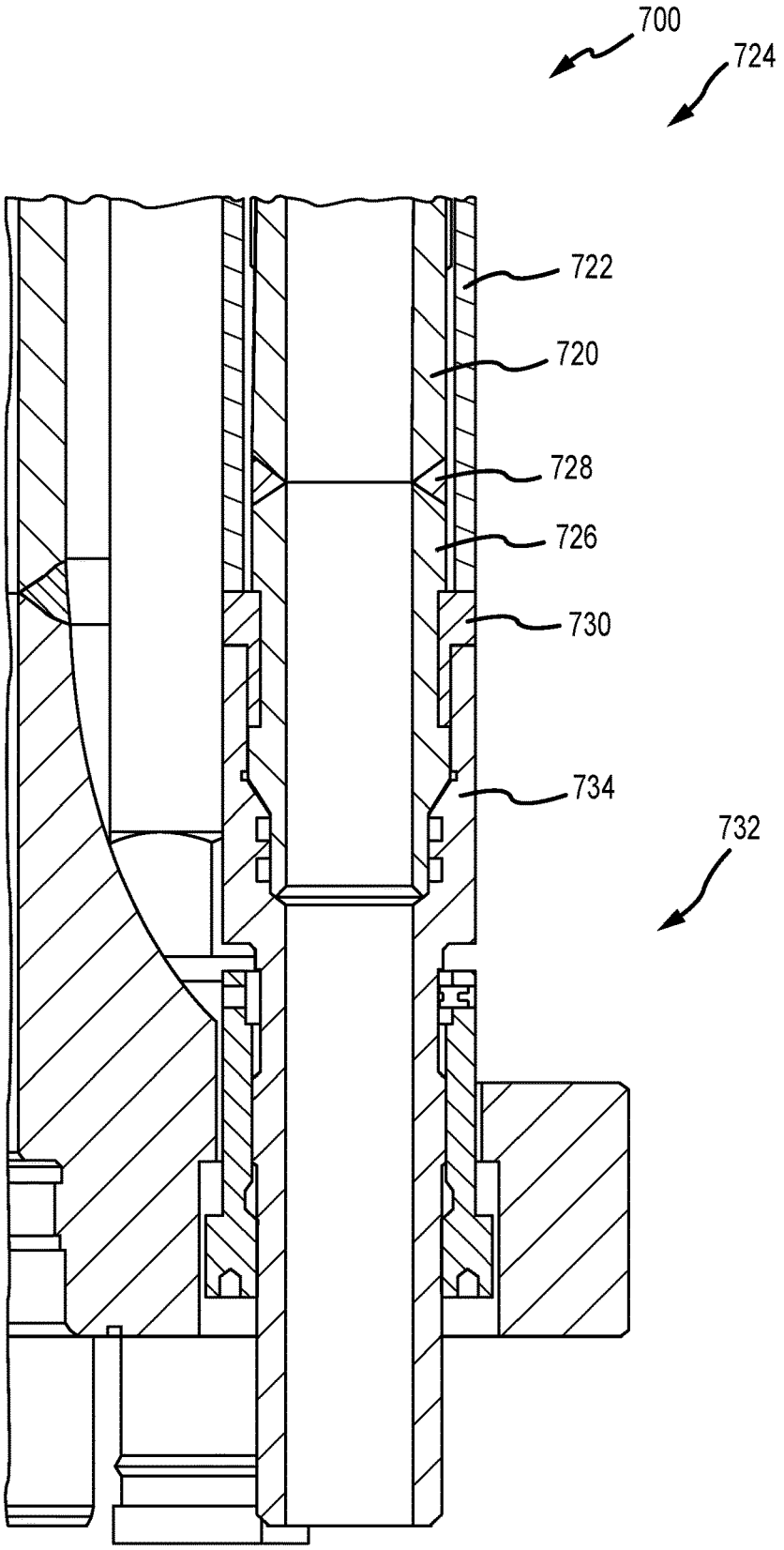
FIG. 7C is a schematic cross-sectional view of an embodiment of a replacement configuration, in accordance with embodiments of the present disclosure.

FIGS. 7A-7C are cross-sectional views of steps to retrofit a riser segment 700. In the illustrated embodiments, FIG. 7A is an auxiliary line configuration 702 including an auxiliary line 704 having a welded connection 706 between a first segment 708 and second segment 710. In the illustrated embodiment, a lock nut 712 is utilized to secure the auxiliary line 704 to a flange 714, which is coupled to the second segment 710. In operation, if the auxiliary line 704 is damaged or otherwise in a condition to be replaced, the riser segment 700 is typically taken out of service to enable reworking of the welded connection 706. This may be inefficient because any subsequent damage or replacements may utilize the same procedure. Accordingly, the auxiliary line may be retrofitted to include the box and pin configuration described herein.

FIG. 7B is an intermediate configuration 716 where at least a portion of the first segment 708 has been removed to provide space to couple a pin to an end 718 of the first segment 708. In the illustrated embodiment, both a tubular portion 720 and a thrust column 722 are removed to facilitate installation of the pin. Furthermore, the second segment 710 is removed to make room for a replacement second segment that includes a box, as will be described below.

FIG. 7C is a replacement configuration 724 that includes a pin 726 coupled to the tubular portion 720, for example via a welded connection 728. In various embodiments, the thrust column 722 is positioned along the tubular portion 720 and at least a portion of the pin 726 to bear against a RTC 730, as described above. In the illustrated embodiment, the second segment 710 is replaced by a third segment 732 that includes a box 734 on an end. The box 734 and RTC 730 each included threads to facilitate coupling of the first segment 708 to the third segment 732. As a result, subsequent replacements may be utilized without further welding operations, as replacement sections may be stored at the platform and coupled to other segments via the RTC 730 and the box 734.

Figure 8:
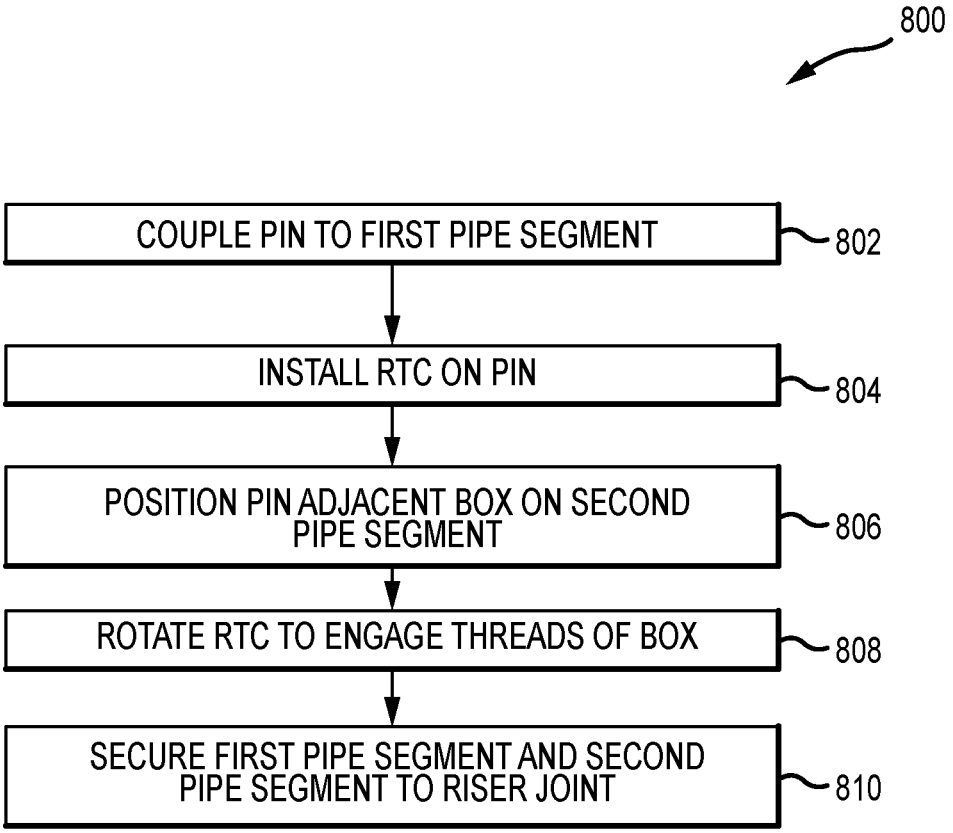
FIG. 8 is a flow chart of an embodiment of a method for installing an auxiliary line via an auxiliary joint assembly, in accordance with embodiments of the present disclosure.

FIG. 8 is a flow chart of an embodiment of a method 800 for installing an auxiliary line to a riser segment. It should be appreciated that for this method and other methods described herein that there may be more or fewer steps. Furthermore, the steps may be performed in any order or in parallel, unless otherwise specifically stated. In this example, a pin is coupled to a first pipe segment (block 802), for example to a pipe segment forming at least a portion of an auxiliary line. In various embodiments, the pin may be retrofit by coupling to an existing auxiliary line that is taken out of service. Additionally, in embodiments, the pin may be coupled or otherwise formed directly onto the pipe segment.

The method continues with the RTC being installed on the pin (block 804). As described above, in various embodiments the RTC is a split collar that may be arranged within a recess formed on the pin and secured to the pin via one or more fasteners. The pin may be arranged adjacent to a box (block 806) that may be coupled to a second pipe segment. For example, the box may include an opening to receive at least a portion of the pin.

In various embodiments, the RTC is rotated to engage the box (block 808). For example, as described above, both the RTC and the box may include threads to facilitate engagement of the box by the RTC via rotation of the RTC about the pin. In certain embodiments, the RTC may be axially restricted such that rotation of the RTC pulls the box toward the RTC. As a result, the first segment is secured to the second segment (block 810), for example via the engagement of the threads of the box and RTC. In this manner, the auxiliary line may be formed from a series of segments each having a box and pin connector that includes the RTC. Such a configuration may be easier to repair and/or replace while on the platform due to the elimination of various welded connections between the segments of the auxiliary line.

In various embodiments, avoiding welding in the production process eliminates rework issues as well as additional weld inspection steps. Additionally, welding procedures are typically done at shore, thereby introducing logistical issues with transporting the riser back to shore. By utilizing systems and methods of the present disclosure, the repair can be done on the drilling rig. This provides a cost saving. Furthermore, by utilizing the RTC for initial development of the auxiliary lines, there may be reduced costs because welding inspections and rework may be reduced or eliminated from the process.

In various embodiments, the threads utilized between the RTC and the riser pin may be tapered. Furthermore, various geometries for the threads may be utilized. Additionally, the location of the threaded portions of the riser pin and the RTC may be adjusted. In various embodiments, the RTC may be incorporated into newly fabricated auxiliary lines or existing lines may be retrofit to include the RTC. Furthermore, systems and methods of the present disclosure may be utilized for other types of service lines that may be utilized in offshore drilling and the like Although the technology herein has been described with reference to particular embodiments, it is to be understood that these embodiments are merely illustrative of the principles and applications of the present technology. It is therefore to be understood that numerous modifications may be made to the illustrative embodiments and that other arrangements may be devised without departing from the spirit and scope of the present technology as defined by the appended claims.

What is claimed is:

1. A system for coupling a first pipe segment to a second pipe segment, comprising:

a pin coupled to the first pipe segment, the pin having a first outer diameter and a second outer diameter, the first outer diameter being larger than the second outer diameter;

a box coupled to the second pipe segment, the box having an opening with an inner diameter larger than the second outer diameter, the opening receiving at least a portion of the pin, wherein at least a portion of a wall of the opening includes threads; and a rotating threaded collar arranged within a recess, the recess being a reduced diameter portion formed in the second outer diameter of the pin, the reduced diameter portion having a smaller diameter than the second outer diameter, and bound by a first shoulder and a second shoulder, both formed in the pin, the rotating threaded collar having an outer diameter substantially equal to the first outer diameter, and at least a portion of the rotating threaded collar including mating threads configured to engage the threads of the box, wherein the rotating threaded collar is rotatable about the pin.

2. The system of claim 1, wherein the pin includes a groove axially displaced from the recess at an end having the second outer diameter, the groove receiving a seal and sealing against the wall of the box when the pin is coupled to the box.

3. The system of claim 2, wherein the pin further comprises a second groove adjacent the groove.

4. The system of claim 1, wherein axial movement of the rotating threaded collar is restricted by the first shoulder and the second shoulder.

5. The system of claim 1, further comprising:

a thread relief formed in the box, the thread relief being proximate the wall of the opening, wherein the thread relief extends radially outward into the box.

6. The system of claim 1, wherein the rotating threaded collar is a split collar, the split collar being coupled together via one or more fasteners.

7. The system of claim 1, wherein an outer profile of the first pipe segment and the second pipe segment is substantially constant after the first pipe segment is coupled to the second pipe segment via the rotating threaded collar.

8. The system of claim 1, wherein the box includes a groove extending radially outwardly and into the box, the groove receiving a seal and sealing against the pin when the pin is coupled to the box.

9. A system for installing auxiliary tubing, comprising:

a riser joint including a flange, the flange extending radially outward from a main line and having a plurality of apertures;

an auxiliary line coupled to the flange via a lock nut, the auxiliary line extending through an aperture of the plurality of apertures, wherein the auxiliary line comprises a first segment and a second segment coupled together via an auxiliary joint assembly, comprising:

a pin coupled to the first segment, the pin having a variable outer diameter including a recess, the recess being a reduced diameter portion of the pin having a recess diameter less than adjacent pin outer diameters upstream and downstream of the recess, and being defined by a first shoulder and a second shoulder;

a box coupled to the second segment, the box having an opening including a variable inner diameter, wherein at least a portion of the variable outer diameter of the pin corresponds to a mating portion of at least a portion the variable inner diameter of the box; and a rotating threaded collar coupled to the pin and arranged within the recess, wherein the rotating threaded collar is axially and radially restricted along the pin and is rotatable about the pin to couple the pin to the box.

10. The system of claim 9, further comprising:

a groove formed in the box, the groove receiving a seal, wherein the groove is arranged at the mating portion to engage the pin when the pin is coupled to the box.

11. The system of claim 9, further comprising:

a groove formed in the pin, the groove receiving a seal, wherein the groove is arranged at the mating portion to engage the box when the pin is coupled to the box.

12. The system of claim 9, wherein axial movement of the rotating threaded collar is restricted by the first shoulder and the second shoulder.

13. The system of claim 9, wherein the rotating threaded collar is a split collar, the split collar being coupled together via one or more fasteners.

14. The system of claim 9, wherein at least a portion of the variable inner diameter of the box includes threads and at least a portion of an outer diameter of the rotating threaded collar includes mating threads, the threads and the mating threads engaging when the rotating threaded collar is rotated to couple the box to the pin.

15. The system of claim 9, wherein the rotation of the rotating threaded collar is independent of rotation of the pin to enable the box to couple to the pin without rotating the pin.

16. A method for coupling a first pipe segment to a second pipe segment, comprising:

coupling a pin to the first pipe segment, the pin including a recess being a reduced diameter portion of the pin having a recess diameter less than adjacent pin outer diameters upstream and downstream of the recess, and being defined by a first shoulder and a second shoulder;

installing a rotating threaded collar within the recess, the rotating threaded collar having an outer diameter substantially equal to the upstream outer diameter of the pin;

coupling a box to the second pipe segment;

aligning the pin with the box such that at least a portion of the pin extends into an opening in the box and threads of the box contact mating threads of the rotating threaded collar; and rotating the rotating threaded collar to engage the threads of the box.

17. The method of claim 16, wherein installing the rotating threaded collar within the recess further comprises:

installing a first portion of the rotating threaded collar within the recess, the rotating threaded collar being a split ring;

installing a second portion of the rotating threaded collar within the recess; and joining the first portion to the second portion via one or more fasteners.

18. The method of claim 16, further comprising:

positioning at least at portion of the second pipe segment within an aperture formed through a flange of a riser segment.

19. The method of claim 18 further comprising:

securing the second pipe segment to the flange via a lock nut.

* * * * *